United States Patent [19]

Kolton et al.

[11] Patent Number: 5,072,866

[45] **Date of Patent: * Dec. 17, 1991**

[54] PLURAL GARMENT SUPPORT HANGER

[75] Inventors: Chester Kolton, Westfield; Stuart S. Spater, Livingston, both of N.J.

[73] Assignee: B & G Plastics, Inc., New York, N.Y.

[ * ] Notice: The portion of the term of this patent subsequent to Dec. 5, 2006 has been disclaimed.

[21] Appl. No.: 362,941

[22] Filed: Jun. 8, 1989

Related U.S. Application Data

[63] Continuation-in-part of Ser. No. 234,212, Aug. 18, 1988, Pat. No. 4,884,726.

[51] Int. Cl.[5] ..... A47G 25/48; A47G 25/14

[52] U.S. Cl. ..... 223/91; 223/85; 223/96; 223/95; 223/88; 24/510; 24/489; D6/315; D6/326; D6/328

[58] Field of Search ..... 223/90, 93, 96, 91, 223/85, 88, 92; 24/510, 489; D6/315, 326, 328

[56] References Cited

U.S. PATENT DOCUMENTS

| | | | |
|---|---|---|---|
| D. 212,444 | 10/1968 | Coon | D8/72 |
| 2,350,859 | 6/1944 | Reckow | 223/95 |
| 2,473,408 | 6/1949 | Alkin | 223/90 |
| 2,947,454 | 8/1960 | Brewer | 223/88 |
| 3,268,128 | 8/1966 | Hobi | 223/96 |
| 3,292,223 | 12/1966 | Esposito | 223/93 |
| 3,456,262 | 7/1969 | Coon | 24/501 |
| 3,946,915 | 3/1976 | Crane | 223/96 |
| 4,335,838 | 6/1982 | Bisk | 223/96 |
| 4,638,930 | 1/1987 | Blanchard | 223/85 |
| 4,660,750 | 4/1987 | Blanchard | 223/91 |
| 4,701,983 | 10/1987 | Warmath | 223/91 |
| 4,884,726 | 12/1989 | Kolton | 223/91 |

*Primary Examiner*—Werner H. Schroeder
*Assistant Examiner*—Bibhu Mohanty
*Attorney, Agent, or Firm*—Robin, Blecker, Daley & Driscoll

[57] ABSTRACT

A hanger for the hanging of plural garments includes a body portion for hanging a first garment, the body portion having a central opening and a hook portion extending outwardly of the body portion and a cross-member bounding the central opening. A clip unit is provided for securement to the cross-member and for releasably receiving a second garment. The clip unit includes first and second members each having a mid-portion and first and second end portions extending oppositely from the mid-portion, the first end portion of the first member defining a detent for engagement with the cross-member to secure the clip unit thereto, the second end portions of the first and second members being adapted for retentive engagement with the second garment. A leaf spring is provided for joinder with the first and second members for assembly of the clip unit, the spring applying bias to the first and second members to effect mutual rotation thereof about the mid-portions thereof to cause the second end portions to be in biased engagement with one another.

13 Claims, 5 Drawing Sheets

PLURAL GARMENT SUPPORT HANGER

CROSS-REFERENCE TO RELATED PATENT APPLICATION

This application is a continuation-in-part of pending patent application Ser. No. 234,212, filed on Aug. 18, 1988, and commonly-assigned herewith, now U.S. Pat. No. 4,884,726.

FIELD OF THE INVENTION

This invention relates generally to garment hangers and pertains more particularly to garment hangers for the hanging of plural garments.

BACKGROUND OF THE INVENTION

A variety of hangers for the hanging of plural garments is presently known, the garments being typically companion parts of a given outfit, e.g., the jacket and trousers of a man's suit or the jacket and skirt of a woman's suit. The hanger conventionally has a main or body part with a hook portion for the hanging of the hanger from a support rod, the body part further defining a central opening bounded in part by a cross-member. The body part receives and support the first grament and the cross-member receives and supports the second garment. In widely known such hangers, the cross-member supports the second garment simply by passing the same through the central opening in overlapped relation to the cross-member.

More interactive such hangers for plural garment support are known, wherein the second garment is positively supported by engagement of an end thereof by biased jaw members associated with the cross-member. One such more interactive hanger construction is seen in Esposito, Jr. U.S. Pat. No. 3,292,223, entitled "Integral Snap-Action Clips" and issued on Feb. 20, 1966. A snap-hinge is employed in the support of such second garment from a hanger, as is shown in FIG. 7 of the '223 patent wherein the cross-member of the hanger is ensnared within the snap-hinge jointly with jaw member engagement of the second garment. An advantage, other than the positive retention of the second garment, resides in that the hanger and snap-hinge attachment may be separately shipped and inventoried. However, applicants herein see a disadvantage in the '223 patent hanger in that the snap-hinges become readily separated from the hanger proper once a customer opens the snap-hinge, such as when removing the second garment to try it on or to more closely inspect it.

In the invention of the '212 application, applicants provided improved such more interactive hangers for the hanging of plural garments, particularly of the type employing snap-hinges for the hanging of such second garment.

In the '212 application, applicants provided, in combination, for the hanging of plural garments, a hanger having a body portion for hanging a first garment, the body portion having a central opening and a hook portion extending outwardly of the body portion and a cross-member bounding the central opening; and snap-hinge units, each in the form of an integral body for the hanging of a second garment and comprising first and second jaw members for releasable retention of the second garment, a snap-hinge selectively operable for biasing the first and second jaw members into such retention of the second garment in one state thereof and for biasing the first and second jaw members to release the second garment from such retention in a second state thereof, and detent structure for securement of the snap-hinge units to the cross-member, irrespective of the state of the snap-hinge.

In a particularly preferred embodiment, the cross-member of the '212 application is configured for facilitating both assembly and release of the snap-hinge means therefrom when desired. To this end, the cross-member defines a track along its periphery having a discontinuity, the track being matable with the detent structure to effect such securement of the snap-hinge units to the cross-member, such track discontinuity being effective to permit joinder of the detent structure and the cross-member and release of the detent structure from such joinder with the cross-member.

More specifically, in such preferred embodiment, the cross-member is elongate, the track discontinuity is of first longitudinal dimension, and the detent structure has a first dimension substantially equal to the track discontinuity first dimension. The cross-member exhibits a second, lateral dimension between its outer surfaces bounding the tracks and the detent structure includes a slot of substantially such second dimension of the cross-member. Further, the detent structure defines an opening into the slot substantially equal to a lateral dimension of the cross-member at the track discontinuity. As is discussed in detail in the '212 application, and also covered hereinafter, such mutually-related dimensions of the cross-member and the detent structure of the snap-hinge units facilitate joinder and release thereof.

The hanger assembly of the '212 application relies fully for garment retention by the snap-hinge units on the retention force available from plastic material. While this arrangement has been found fully satisfactory for relatively thin garments, and like matter of limited thickness, applicants have found that the use of such assembly with relatively thick garments or matter can give rise to some measure of difficulty. By way of example, applicants have observed that a thick garment hung from the above-discussed snap-hinge unit will be adequately retained. However, when the garment is removed from the hanger assembly, as by removal from the snap-hinge units, the latter may exhibit a "set" open stance, wherein the jaws remain spaced from one another by essentially the thickness of the garment removed therefrom. An indeterminate time period need expire for such set to disappear and for the snap-hinge unit to recover to its initial retention capability.

A different approach to such more interactive garment hangers is seen in Blanchard U.S. Pat. No. 4,660,750. Blanchard employs a unit applied to the cross-member of a plural garment hanger of clothes-pin type. The jaw members of the unit have a leaf spring of generally inverted U-shape straddling them and biasing the jaw members into intensely biased engagement of character which would not exhibit the set open stance above discussed. Various other such biased units are to be seen in Coon U.S. Pat. No. 3,456,262, Bisk et al. U.S. Pat. No. 4,335,838 and Coon Patent Des. U.S. Pat. No. 212,444.

In the Blanchard, Coon and Bisk et al. patents, the hanger cross-member is ensnared within the jaw members and, to assemble the clip unit with the cross-member, it is necessary to overcome the leaf spring bias to force the cross-member to its position within the jaw members. Further, the spring must have bias capacity for two purposes, namely, for maintaining the jaw members with the cross-member and for retaining a garment with the cross-member.

SUMMARY OF THE INVENTION

The present invention has as its principal object the provision of improved such more interactive hangers for the hanging of plural garments.

A more particular object of the invention is to provide an improved hanger of the type employing clip units for the hanging of such second garment which do not exhibit such set upon removal of the garment therefrom and yet do not rely on bias elements for retaining the clip unit with the hanger.

In attaining the foregoing and other objects, the invention provides in combination, for the hanging of plural garments: a hanger having a body portion for hanging a first garment, the body portion having a central opening and a hook portion extending outwardly of the body portion and a cross-member bounding the central opening; clip means for securement to the cross-member and for releasably receiving a second garment, and means for joinder of members for assembly of the clip means, the joinder means applying bias to the members to effect mutual rotation thereof about the mid-portions thereof to cause the second end portions to be in biased engagement with one another. The clip means including first and second members each having a mid-portion and first and second end portions extending oppositely from the mid-portion, the first end portion of the first member defining detent means for engagement with the cross-member to secure the clip means thereto, the second end portions of the first and second members being adapted for retentive engagement with the second garment.

In a further aspect, the invention provides a clip member for releasably retaining a garment on the cross-member of a hanger, comprising: first and second members each having a mid-portion and first and second end portions extending oppositely from the mid-portion, the first end portion of the first member defining detent means for engagement with the cross-member to secure the clip means thereto, the second end portions of the first and second members being adapted for retentive engagement with the second garment, and means for joinder with the first and second members for assembly of the clip means, the joinder means being disposed distal from the first end portion of the first member and applying bias to the first and second members t effect mutual rotation thereof about the mid-portions thereof to cause the second end portions to be in biased engagement with one another.

The foregoing and other objects and features of the invention will be further understood from the following detailed description of preferred embodiments thereof and from the drawings wherein like reference numerals identify like components and parts throughout.

DESCRIPTION OF PREFERRED EMBODIMENTS AND PRACTICES

Figure 3:
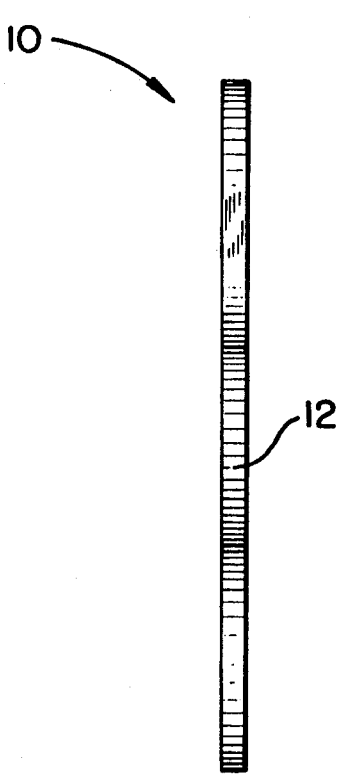
FIG. 3 is a right side elevation of the hanger of FIG. 1.

Referring to FIGS. 1–6, hanger 10 is integrally formed of a suitable plastic material and includes a body portion 12 for hanging a first garment, as above alluded to, typically the jacket of a two-piece outfit. Body portion 12 has a hook portion 14 extending outwardly thereof, for the hanging of hanger 10 on a display support rod (not shown). Body portion 12 further includes a central opening 16 and a cross-member 18 bounding the central opening.

Cross-member 18 has upper outer surface 20 immediately bounding opening 16, including track 22 with central track discontinuity 24, and lower outer surface 26, distal from opening 16 including track 28 with central track discontinuity 30. The cross-member is elongate and the track discontinuities 24 and 30 are each of first longitudinal dimension D1. Each of tracks 22 and 28 has a lateral dimension D2 at the locations of such track discontinuities. A lateral dimension D3 applies as between upper and lower outer surfaces 20 and 26 of cross-member 18.

Turning now to FIGS. 7–13, clip unit 32 includes first and second jaw members 34 and 36, each in the form of an integral plastic body and jointly for use in the releasable retention of such second garment. Member 34 has upper portion 34*a*. middle portion 34*b* and lower portion 34*c* defining gripping projection 34*d*. Upper portion 34*a* is centrally open as at 34*e* and middle portion 34*b* defines a semi-cylindrical recess 34*f*.

Member 36 has upper portion 36*a*, middle portion 36*b* and lower portion 36*c* defining gripping projections 36*d* and 36*e* with recess 36*f* therebetween. Upper portion 36*a* is centrally open as at 36*g* and middle portion 36*b* is centrally open as at 36*h* and defines a semi-cylindrical bearing surfaces 36*i* and 36*j*.

Jaw members 34 and 36 are assembled by placing bearing surfaces 36*i* and 36*j* in recess 34*f* and by then inserting leaf spring 38 through opening 34*e* and into opening 36*h* to straddle the middle and lower portions of members 34 and 36, spring 38 being distal from upper portion 36*a* of member 36.

Figure 1:
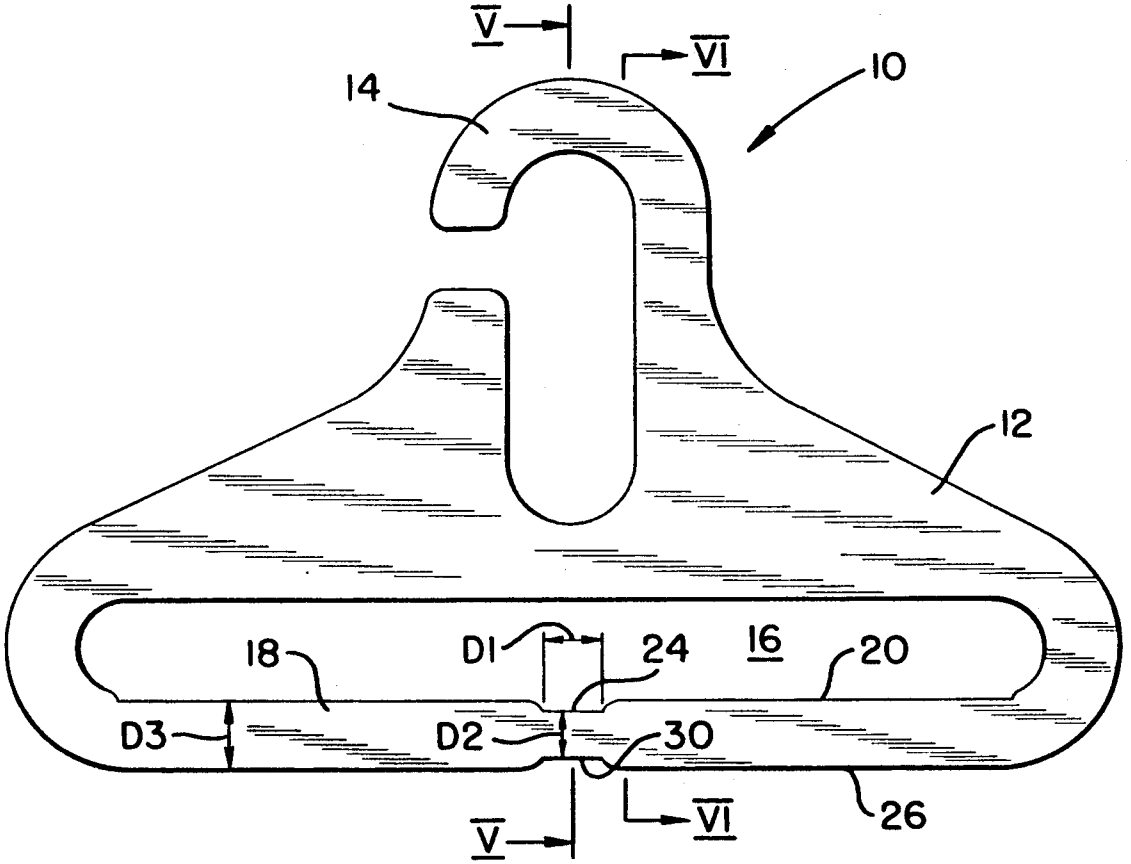
FIG. 1 is a front elevation of a hanger in accordance with the invention.
Figure 2:
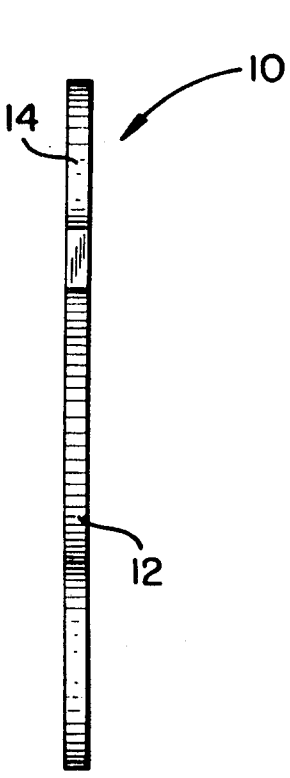
FIG. 2 is a left side elevation of the hanger of FIG. 1.
Figure 6:
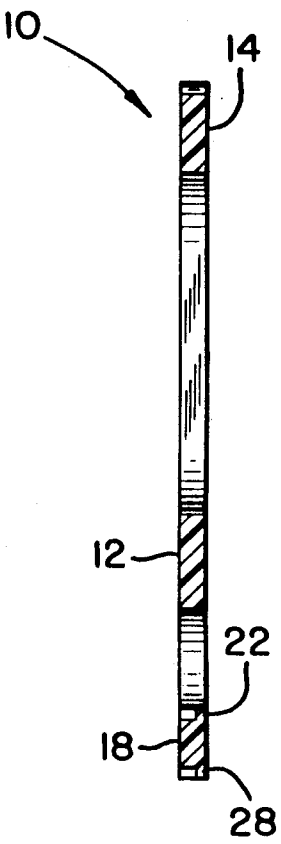
FIG. 6 is a sectional view of the FIG. 1 hanger as would be seen from plane VI—VI of FIG. 1.
Figure 5:
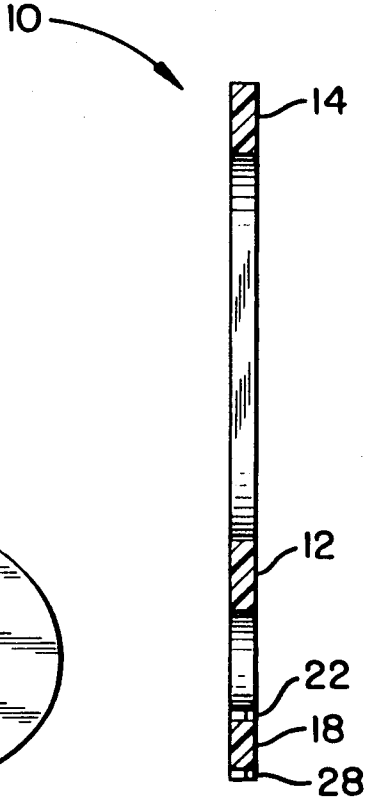
FIG. 5 is a sectional view of the FIG. 1 hanger as would be seen from plane V—V of FIG. 1.
Figure 4:
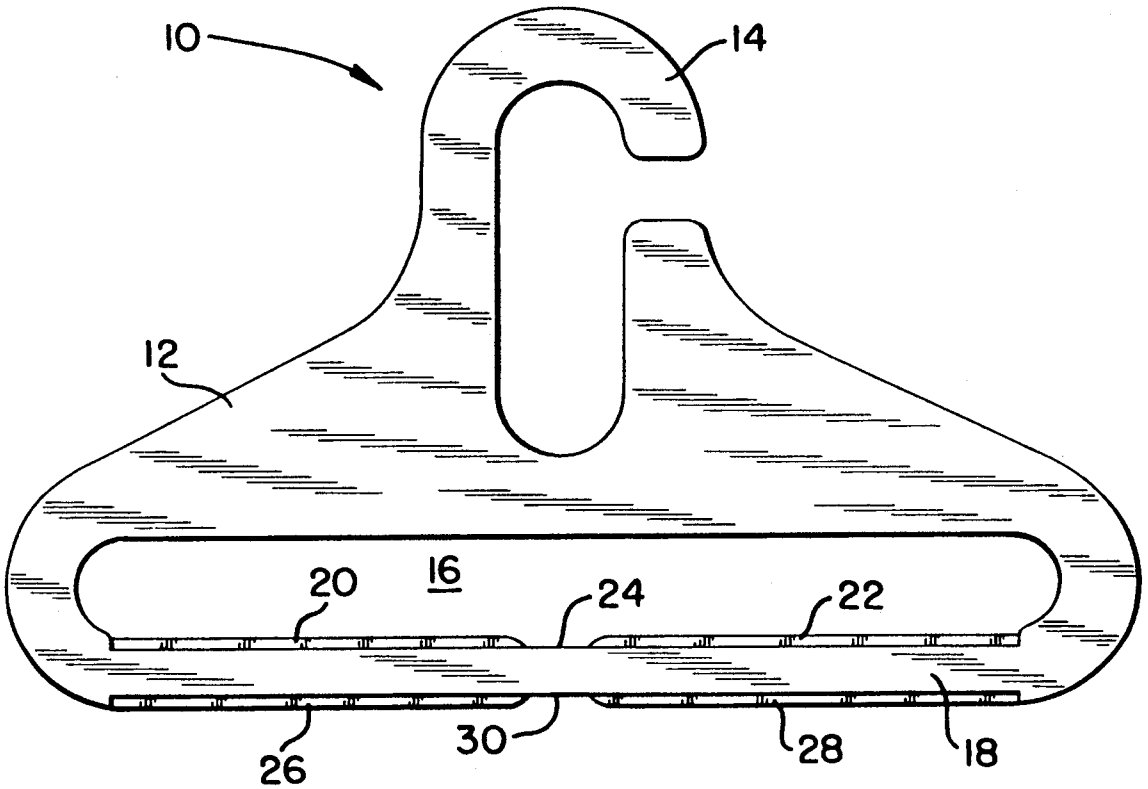
FIG. 4 is a rear elevation of the hanger of FIG. 1.
Figure 9:
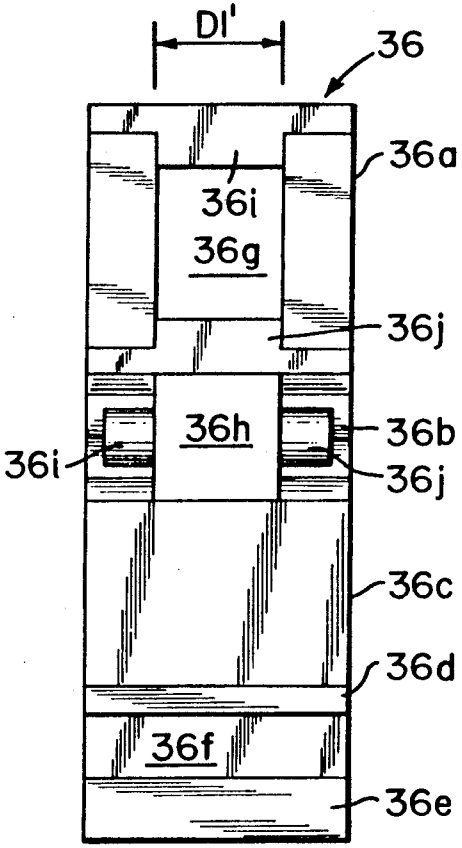
FIG. 9 is a front elevation of a second jaw member of a clip unit in accordance with the invention.
Figure 10:
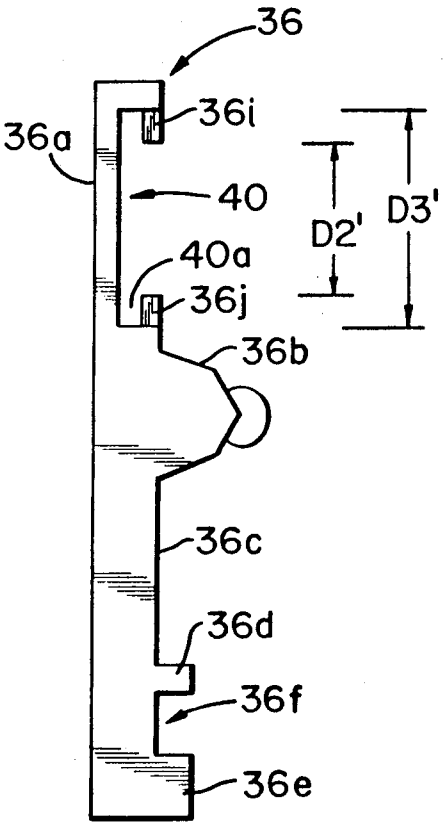
FIG. 10 is a left side elevation of the jaw member of FIG. 9.
Figure 7:
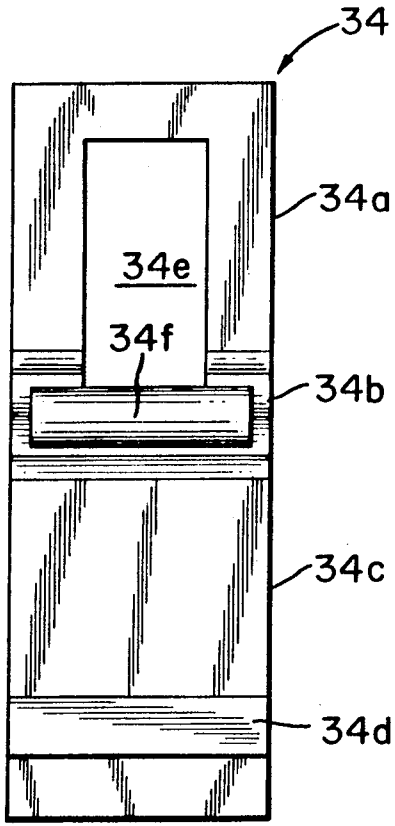
FIG. 7 is a front elevation of one jaw member of a clip unit in accordance with the invention.
Figure 8:
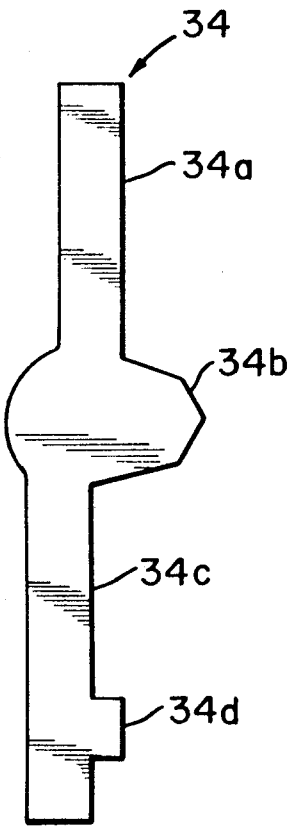
FIG. 8 is a left side elevation of the jaw member of FIG. 7.

Upper portion 36*a* of member 36 further defines detent means 40 having slot 40*a* and retainers 36*i* and 36*j*, the slot having dimension D3', equal to or slightly in excess of dimension D3 of FIG. 1, and the retainers being spaced by dimension D2', which is equal to or slightly in excess of dimension D2 of FIG. 1. The clip unit has a further dimension D1', which is equal to or slightly less than dimension D1 of FIG. 1.

Figure 11:
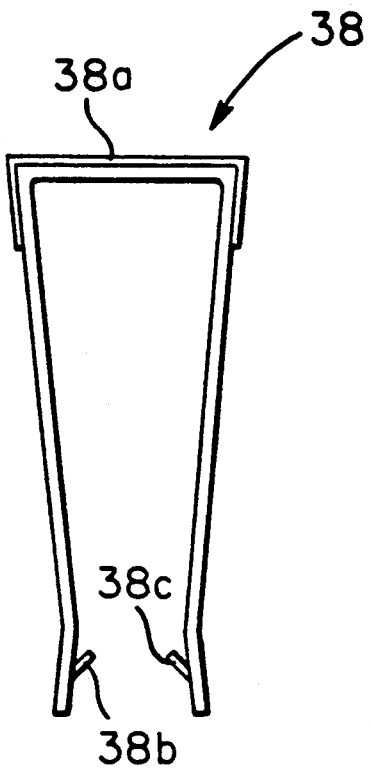
FIG. 11 is a front elevation of a joinder and bias element for use with the jaw members of FIGS. 7–10.
Figure 12:
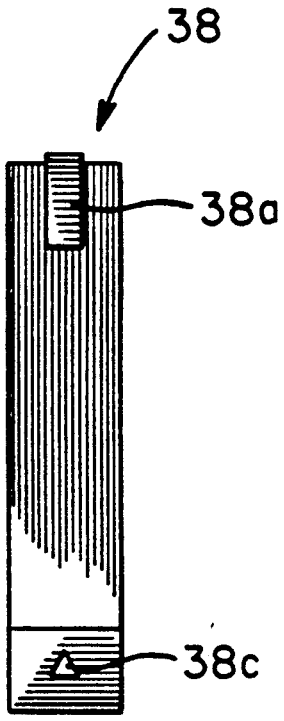
FIG. 12 is a right side elevation of the element of FIG. 11.

Leaf spring 38 is preferably a metallic member and, as is seen in FIGS. 11 and 12, desirably has strengthening rib 38*a* over its upper branch and projections 38*b* and 38*c* struck from the lower portions of its respective legs to enhance frictional engagement with jaw members 34 and 36.

Figure 14:
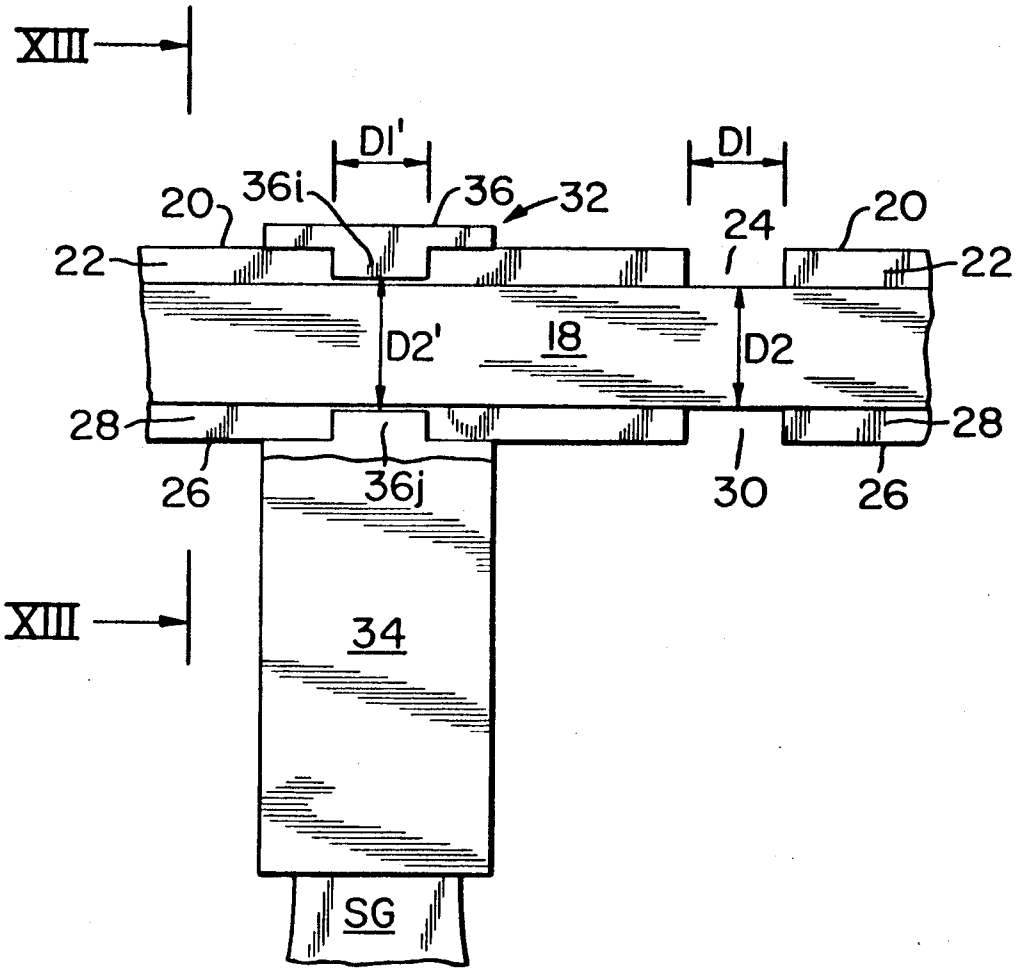
FIG. 14 is a side elevation of FIG. 13.
Figure 13:
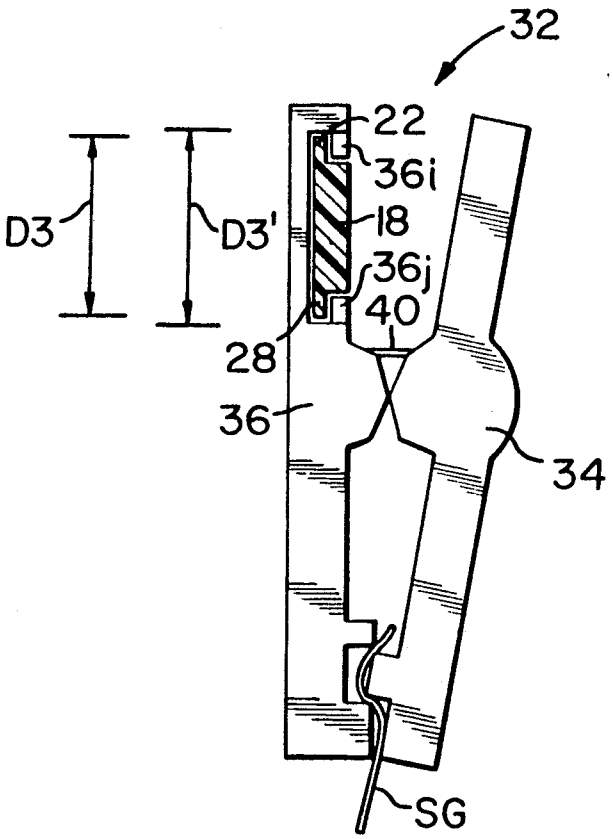
FIG. 13 depicts the clip unit of the invention in assembly with the FIG. 1 hanger, which is shown in section.

Turning to FIGS. 13 and 14, clip unit 32 is shown assembled with cross-member 18. This assembly was reached by placing detent means 40 of the clip unit in registry with track discontinuities 24 and 30, such that retainers 36*i* and 36*j* are in registry with discontinuity 24 and slot 40*a* bridges cross-member 18 at its dimension D2. At such juncture, since dimension D1' is selected to be slightly less than or substantially equal to dimension D1 and since dimension D2 is selected to be slightly less than or substantially equal to dimension D2', cross-member 18 can enter slot 40*a*. Then, since dimension D3 is selected to be slightly less than or substantially equal to dimension D3', the clip unit may be displaced rightwardly or leftwardly from the track discontinuity registration position to become assembled with cross-member 18. Further, by selection of dimension D3 to be larger than dimension D2', such assembly becomes retentive as against movement of the clip unit outwardly of the plane of FIG. 14.

For release of the clip unit from cross-member 18, one simply displaces the same into registration with track discontinuities 24 and 30 and reverses the above operation.

It will be appreciated that such assembly and release are accomplished irrespectively of the state of clip unit 32. In FIGS. 13 and 14, the clip unit is shown in its closed state and in retentive engagement with tracks 22 and 28 of cross-member 18 and with second garment SG. Opening of the clip unit will evidently have no effect on the retention thereof by cross-member 18.

Various changes in construction and modifications to practice may be introduced without departing from the invention. The foregoing detailed discussion of preferred embodiments and practices will accordingly be understood to be in an illustrative and not in a limiting sense. The true spirit and scope of the invention is set forth in the following claims.

I claim:

1. In combination, for the hanging of plural garments;

(a) a hanger comprised of an integral body of synthetic material having a body portion for hanging a first garment, said body portion having a central opening and a hook portion extending outwardly of said body portion and a cross-member bounding said central opening;

(b) clip means for securement to said cross-member and for releasably receiving a second garment, said clip means including (1) first and second members each having a mid-portion and first and second end portions extending oppositely from said mid-portion, said first end portion of said first member defining detent means for engagement with said cross-member to secure said clip means thereto, said second end portions of said first and second members being adapted for retentive engagement with said second garment, and (2) means for joinder with said first and second members for assembly of said clip means, said joinder means applying bias to said first and second members to effect mutual rotation thereof about said mid-portions to be in biased engagement with one another, said cross-member being configured in part for effecting such securement of said clip means thereto and in other part for facilitating release of said clip means therefrom when desired.

2. The invention claimed in claim 1 wherein said cross-member defines a track along its periphery having a discontinuity, said track being matable with said detent means to effect such securement of said clip means to said cross-member, such track discontinuity being configured to permit said joinder of said detent means and said cross-member and said release of said detent means from such joinder with said cross-member.

3. The invention claimed in claim 2 wherein said cross-member is elongate, wherein said track discontinuity is of first longitudinal dimension, and wherein said detent means has a first dimension substantially equal to said track discontinuity first dimension to permit such joinder and release of said detent means and said cross-member.

4. The invention claimed in claim 3 wherein said cross-member has first and second outer surfaces, each defining such rack therealong, said first outer surface bounding said central opening, said detent means includes a slot exhibiting a first dimension substantially equal to said width of said cross-member between said first and second outer surfaces at a location other than at said track discontinuity.

5. The invention claimed in claim 4 wherein said detent means defines an opening into said slot, said slot exhibiting a second dimension across said opening, said second slot dimension being substantially equal to said width of said cross-member between said first and second outer surfaces at said track discontinuity.

6. A clip member for releasably retaining a garment on an elongate cross-member of a hanger, comprising:

(a) first and second members each having a mid portion and first and second end portions extending oppositely from the mid-portion, the first end portion of the first member defining detent means independently of said second member for engagement with the cross-member to secure the clip means thereto, said clip member being releasable from said cross-member by displacement of said first end portion of said first member transversely of said cross-member, the second end portions of the first and second members being adapted for retentive engagement with the second garment; and (b) means for joinder with the first and second members for assembly of the clip means, the joinder means being disposed distal from the first end portions of the first and second members, said joinder means extending around said mid-portions of said first and second members and engaging outward surfaces of the second end portions of the first and second members and applying bias to the first and second members to effect mutual rotation thereof about the mid-portions thereof to cause the second end portions to be in biased engagement with one another.

7. The invention claimed in claim 6 wherein said cross-member defines a track along its periphery having a discontinuity, said track being matable with said detent means to effect such securement of said clip means to said cross-member, such track discontinuity being configured to permit said joinder of said detent means and said cross-member and said release of said detent means from such joinder with said cross-member.

8. The invention claimed in claim 7 wherein said cross-member is elongate, wherein said track discontinuity is of first longitudinal dimension, and wherein said detent means has a first dimension substantially equal to said track discontinuity first dimension to permit such joinder and release of said detent means and said cross-member.

9. The invention claimed in claim 8 wherein said cross-member has first and second outer surfaces, each defining such track therealong, said first outer surface bounding said central opening, said detent means includes a slot exhibiting a first dimension substantially equal to said width of said cross-member between said first and second outer surfaces at a location other than at said track discontinuity.

10. The invention claimed in claim 9 wherein said detent means defines an opening into said slot, said slot exhibiting a second dimension across said opening, said second slot dimension being substantially equal to said width of said cross-member between said first and second outer surfaces at said track discontinuity.

11. A hanger having a body portion for hanging a first garment, said body portion having a central opening and a hook portion extending outwardly of said body portion and a cross-member bounding said central opening, said cross-member being adapted for releasable retention of clip means for releasably receiving a second garment, said cross-member defining a track along its periphery having a discontinuity, said track discontinuity being configured to permit joinder of said clip means to said cross-member and to facilitate release of said clip means from such joinder with said cross-member.

12. The hanger claimed in claim 11 wherein said hanger is an integral body of synthetic material of generally flat configuration, said cross-member having a continuous elongate cross-member part disposed adjacent to said cross-member track.

13. The hanger claimed in claim 12 including a further track disposed adjacent to said continuous elongate cross-member part oppositely of said first-mentioned track and defining a track discontinuity in location registry with the discontinuity defined by said first-mentioned track.

* * * * *